US007414922B2

(12) United States Patent
Ferri et al.

(10) Patent No.: US 7,414,922 B2
(45) Date of Patent: Aug. 19, 2008

(54) WATER-RESISTANT PORTABLE APPARATUS COMPRISING AN ELECTROACOUSTIC TRANSDUCER

(75) Inventors: Yvan Ferri, Lausanne (CH); Paul Dinnissen, Schwadernau (CH); Jean-Jacques Born, Morges (CH)

(73) Assignee: Asulab S.A., Marin (CH)

( * ) Notice: Subject to any disclaimer, the term of this patent is extended or adjusted under 35 U.S.C. 154(b) by 396 days.

(21) Appl. No.: 10/541,534

(22) PCT Filed: Dec. 18, 2003

(86) PCT No.: PCT/EP03/51047

§ 371 (c)(1),
(2), (4) Date: Jul. 8, 2005

(87) PCT Pub. No.: WO2004/066041

PCT Pub. Date: Aug. 5, 2004

(65) Prior Publication Data

US 2006/0114751 A1 Jun. 1, 2006

(30) Foreign Application Priority Data

Jan. 8, 2003 (EP) ..... 03075099

(51) Int. Cl.
*G04B 47/02* (2006.01)
*G04C 37/00* (2006.01)
*G04C 21/00* (2006.01)
*H04M 1/00* (2006.01)

(52) U.S. Cl. ..... 368/13; 368/88; 368/250; 370/433.1

(58) Field of Classification Search ..... 368/88, 368/243, 244, 250, 291, 292, 309, 315; 379/430, 379/433.01, 433.1
See application file for complete search history.

(56) References Cited

U.S. PATENT DOCUMENTS

| | | | | |
|---|---|---|---|---|
| 3,577,876 | A * | 5/1971 | Spadini | 368/250 |
| 3,777,472 | A * | 12/1973 | Iinuma | 368/255 |
| 4,180,970 | A * | 1/1980 | Tokunaga et al. | 368/243 |
| 4,197,697 | A * | 4/1980 | Mori et al. | 368/315 |
| 4,374,624 | A * | 2/1983 | Murata | 368/250 |
| 4,534,661 | A * | 8/1985 | Kurita | 368/250 |
| 4,918,674 | A * | 4/1990 | Shimozono et al. | 368/255 |
| 6,219,304 | B1 * | 4/2001 | Mignot et al. | 368/88 |
| 6,321,868 | B1 * | 11/2001 | Mignot et al. | 181/120 |

FOREIGN PATENT DOCUMENTS

| | | |
|---|---|---|
| CH | 691 334 A5 | 6/2001 |
| EP | 0 899 634 A1 | 3/1999 |
| EP | 0 899 635 A1 | 3/1999 |
| EP | 1 063 632 A1 | 12/2000 |
| EP | 1 130 944 A1 | 9/2001 |
| WO | WO 00/36473 | 6/2000 |

OTHER PUBLICATIONS

International Search Report issued in corresponding application No. PCT/EP03/51047 completed Apr. 2, 2004 and mailed Apr. 20, 2004.

* cited by examiner

*Primary Examiner*—Vit W Miska
(74) *Attorney, Agent, or Firm*—Griffin & Szipl, P.C.

(57) ABSTRACT

The present invention concerns a water-resistant portable apparatus including a case in which there is mounted an electroacoustic transducer separated from an inlet cavity in a water-resistant manner by a deformable membrane. This inlet cavity is arranged in said case in direct communication with the exterior. The electroacoustic transducer and the inlet cavity are arranged collaterally such that at least one part of said transducer, respectively of the cavity, of a determined thickness is arranged in the same slice of the case and in that an acoustic channel connects the transducer to the membrane to transmit acoustic vibrations.

16 Claims, 3 Drawing Sheets

Fig.5 ART ANTERIEUR

WATER-RESISTANT PORTABLE APPARATUS COMPRISING AN ELECTROACOUSTIC TRANSDUCER

This is a National Phase Application in the United States of International Patent Application No. PCT/EP2003/51047 filed Dec. 18, 2003, which claims priority on European Patent Application No. 03075099.6, filed Jan. 8, 2003. The entire disclosures of the above patent applications are hereby incorporated by reference.

FIELD OF THE INVENTION

The present invention concerns a water-resistant portable apparatus, such as for example a wristwatch, comprising an electroacoustic transducer.

BACKGROUND OF THE INVENTION

A water-resistant portable apparatus of this type comprises a case in which an electroacoustic transducer is mounted, separated in a water-resistant manner by a deformable membrane from an inlet cavity, which is arranged in the case and in direct communication with the exterior.

Such portable apparatus are known from the prior art, particularly from EP Patent No. 0 899 635 filed in the name of the present Applicant, and incorporated herein by reference. This document discloses a water-resistant portable apparatus 1, shown in FIG. 5, comprising a case 2 in which there is mounted an acoustic transducer 21 so that it communicates in a water-resistant manner with the exterior of case 2 via acoustic energy. Acoustic transducer 21 is secured to a deformable membrane 15, separating it in a water-resistant manner from an inlet cavity 11 arranged in the case and in direct communication with the exterior.

A structure of this type has, however, several drawbacks. In the case of a piezo-electric type acoustic transducer, as shown, the control circuit housed in the case on a printed circuit board or PCB comprises, in particular, an amplifier with an integrated voltage multiplier, which has to be adapted to the transducer, and whose design on the PCB is more complex and consequently requires a larger surface.

Moreover, the connections between the piezo-electric transducer and a PCB are achieved by means of electrical wires, which requires difficult assembling operation on the transducer and operations for welding such wires.

Furthermore, the water-resistance of the structure shown is only guaranteed for the elements located above the deformable membrane. There is no device provided for sealing any electrical or electronic components located in the bottom of the case in a water-resistant manner.

The idea consisting in simply replacing the piezo-electric type acoustic transducer with an electrodynamic type acoustic transducer, i.e. a transducer with a moving conductor in which the moving part is a conductor through which a current, provided by an external source or induced by an external magnetic field, passes, raises difficulties as regards compactness in case, a dynamic transducer being relatively voluminous and whose thickness, in particular, is not negligible.

SUMMARY OF THE INVENTION

In order to overcome the drawbacks of the prior art, the idea according to the invention is to make a water-resistant portable apparatus comprising a simple transducer structure occupying a reduced thickness in the case of the apparatus.

Thus one advantageous embodiment of the invention concerns a water-resistant portable apparatus as defined in the preamble of the description, characterized in that the electroacoustic transducer and the inlet cavity are arranged in a collateral manner such that at least one part of a determined thickness of the transducer and respectively the cavity, are present in the same slice of the case and in that an acoustic channel connects the transducer to the membrane to transmit acoustic vibrations.

Advantageous variants are set out in the dependent claims.

BRIEF DESCRIPTION OF THE DRAWINGS

Other features and advantages of the invention will appear during the following description, given solely by way of example and made with reference to the annexed drawings, in which.

FIG. 5, already described, shows a water-resistant portable apparatus in accordance with the prior art.

BRIEF DESCRIPTION OF THE DRAWINGS

In the following description, the various embodiments of the invention will be illustrated in the application thereof to a wristwatch. It is clear, however, that any other portable apparatus of small dimensions, comprising an electroacoustic transducer and capable of being immersed in a liquid such as water, to a determined depth, can form the object of the present invention. Furthermore, in the various embodiments shown, the electroacoustic transducer is a loudspeaker, although a transducer, such as a microphone, can also be advantageously used with these different embodiments.

Figure 1:
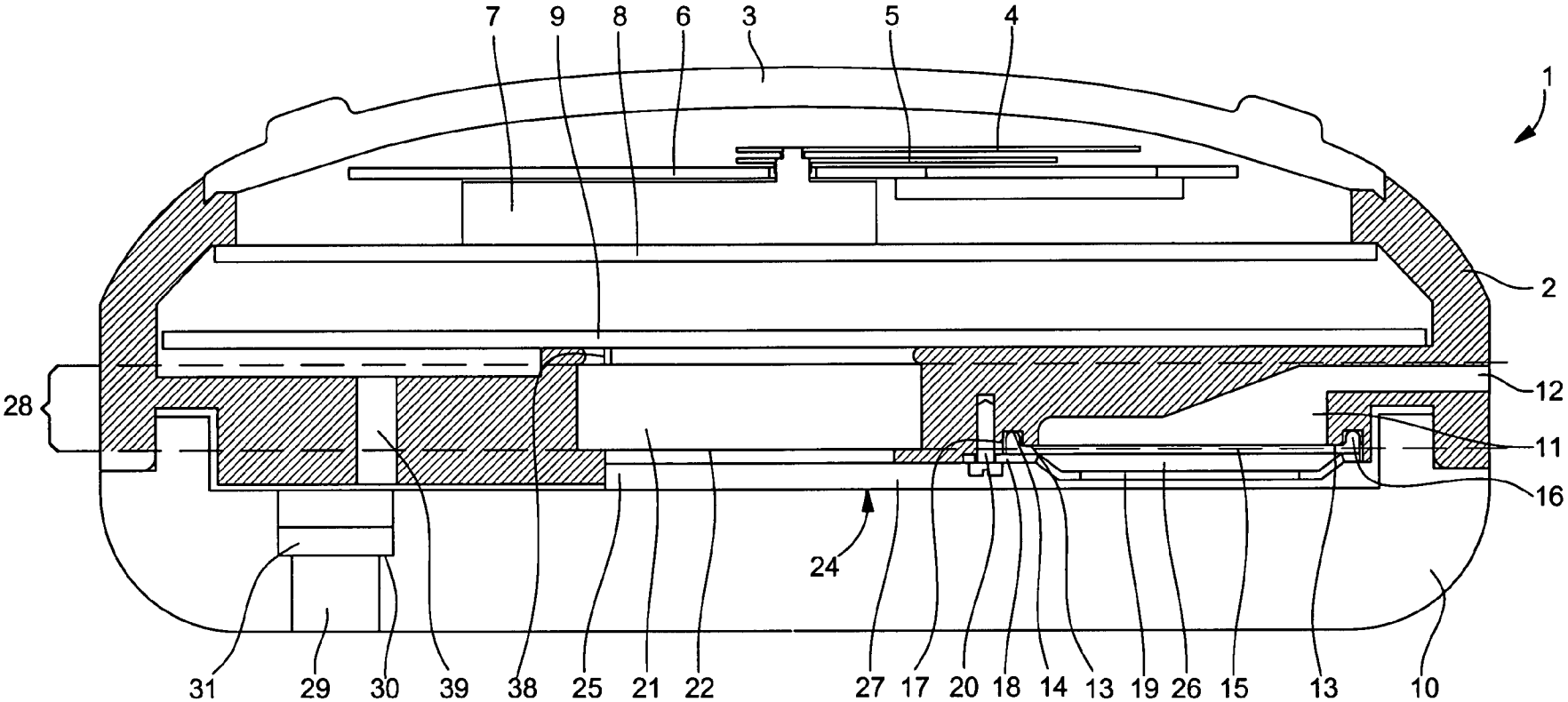
FIG. 1 shows a cross-section of the electroacoustic transducer of a portable apparatus according to a first embodiment.

Thus, according to a first embodiment of the invention, there is shown in FIG. 1, a cross-section of a wristwatch 1, guaranteed to be water-resistant to a determined depth of water, for example a depth of 30 meters, which is a value often provided in practice.

There can be seen in FIG. 1 the following parts of watch 1: the case 2, crystal 3, hands 4 and 5, dial 6, miniature motor 7, printed circuit board or PCB 8 for the watch. All of these elements, and those shown in outline, or not visible in this Figure, such as the quartz, the gear train, integrated circuit, etc. are conventional and will not, therefore be described here. It will be noted that advantageously, the watch forms a portable telephone comprising a second printed circuit board 9 for the telephone.

In the case shown, the case comprises a back cover 10 secured in a water-resistant manner to the case by any means, for example bonding, screwing or snap fit. It will be noted that back cover 10 and case 2 can be formed by a single moulded part. Case 2 has an inlet cavity or chamber 11 preferably of generally circular shape and in direct communication with the exterior via an inlet channel 12, which opens out therein laterally. Around cavity 11, case 10 has a peripheral rib 13 with a rounded edge and contiguous with an annular groove 14 located on the exterior with respect to rib 14.

A membrane 15, formed of a circular disc on which a peripheral edge 16 is formed, housed in groove 14 and whose external surface is bonded to a peripheral wall 17 arranged around groove 14. Membrane 15 is compressed by an annular support surface 18 of a protective member 19, for example a circular grid, fixedly mounted in case 2, for example by means of screws 20. It will be noted that membrane 15 can be held by mounting rings that are not shown, acting as a support surface, protective member 19 not being necessary.

Thus, membrane 15 makes the inside of watch 1 water-resistant as regards the exterior. Membrane 15 is made of a water-resistant and gas-proof deformable material, for example silicon. In a zone separate from the assembly that has just been described, back cover 10 includes a through passage 29 with a shoulder 30 against which there is arranged a pressure compensation disc 31. This latter is waterproof, but pervious to air. This structure is connected to acoustic channel 24 via air passages made inside case 2. All of these elements 29, 30 and 31 form pressure balancing means for balancing slow variations in the differential pressure on either side of said deformable membrane.

It will be noted, however, that deformable membrane 15 can be designed such that it fulfils the pressure compensation function instead of the aforementioned circuit. In such case, membrane 15 has to be made of a flexible water-resistant but gas-proof or semi-gas proof material whose static pressure varies at a very low frequency.

An electroacoustic transducer 21 is fixedly mounted in a housing of case 2 provided for such purpose and connected by a simple electrical contact 38 to printed circuit board 9. Transducer 21 and inlet cavity 11 are arranged collaterally such that at least one part of a determined thickness of transducer 21 and respectively cavity 11 are arranged in the same slice 28 of the case. The "slice" means the part of an object comprised between two parallel planes. Preferably, cavity 11 is dimensioned such that its thickness is less than or equal to that of transducer 21, with the thickness of slice 28 of the case advantageously corresponding to that of transducer 21.

It will be noted that a channel 39 can also be provided inside case 2 so as to ensure that the pressure is identical above and below transducer 21.

However, other arrangements wherein transducer 21 and/or cavity 11 are inclined can be envisaged, provided that one slice of the case passes through these two elements over a minimum determined thickness, of the order of a millimetre, so as to reduce the total thickness of watch 1 by the same amount.

Figure 4:
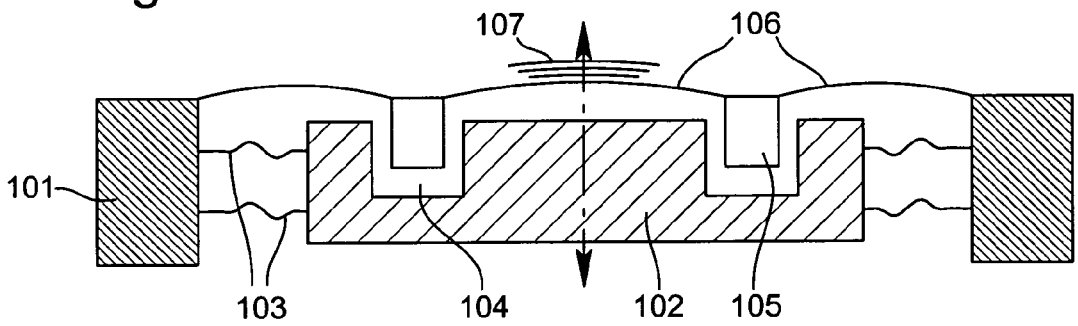
FIG. 4 shows a schematic view of a dynamic loudspeaker.
Figure 4:
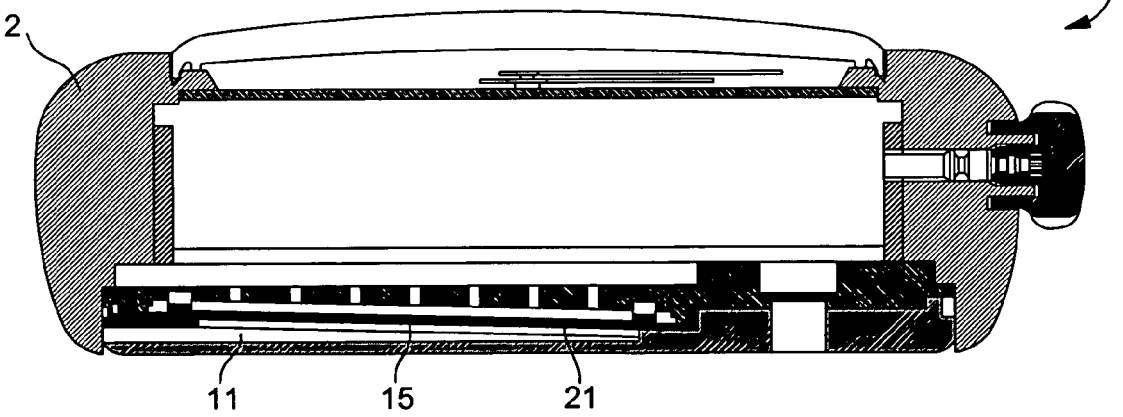

In the case shown, electroacoustic transducer 2 is a dynamic loudspeaker, a schematic view of which and the operation of which is given in relation to FIG. 4. This transducer advantageously has an additional vibrator function as is also explained in relation to FIG. 4. This dynamic transducer is controlled in a conventional manner by means of a simple control circuit comprising in particular a standard amplifier, said control circuit being easily able to be integrated into a reduced space of printed circuit board 9.

Transducer 21 comprises a membrane 22 of elastomeric material acting as a loudspeaker within the audible range of frequencies. The additional vibrator function is achieved by a vibrating element that is not visible in this Figure, for a determined frequency, allowing a good level of vibration for watch 1, for example 140 Hertz. It will be noted that the vibrating element is preferably directed towards the inside of the case so as to obtain better vibration for watch 1, and that flexible membrane 22 is directed towards back cover 10 of the case.

In order to transmit the acoustic vibrations of membrane 22 to deformable membrane 15, there is provided in back cover 10 of the case, an acoustic channel 24, which comprises a first chamber 25 arranged facing membrane 22 of the transducer, a second chamber 26 arranged facing deformable membrane 15 and a connecting conduit 27 between the two chambers 25 and 26. The second chamber 26 corresponds to the zone located between deformable membrane 15 and protective member 19 or the back cover 10 of the case, if there is no protective member.

The behaviour of membrane 15 is as follows. When watch 1 is worn outside water, membrane 15 has a flat configuration in which it is free to be deformed to transmit the acoustic vibrations produced by transducer 21 to the exterior.

However, when watch 1 has just been immersed, membrane 15 will be deformed because of an abrupt variation in the differential pressure prevailing on its two sides. It will then adopt a convex shape in the direction of back cover 10, since the pressure compensation path through the circuit provided for this purpose, or through the membrane itself in the case of a hydrophobic membrane, does not balance the pressure difference quickly enough. From a certain hydrostatic pressure value, the deformation of membrane 15 will be such that it will be applied against back cover 10 or against protective member 19, which thus provides an efficient support preventing any deterioration of membrane 15.

Figure 2:
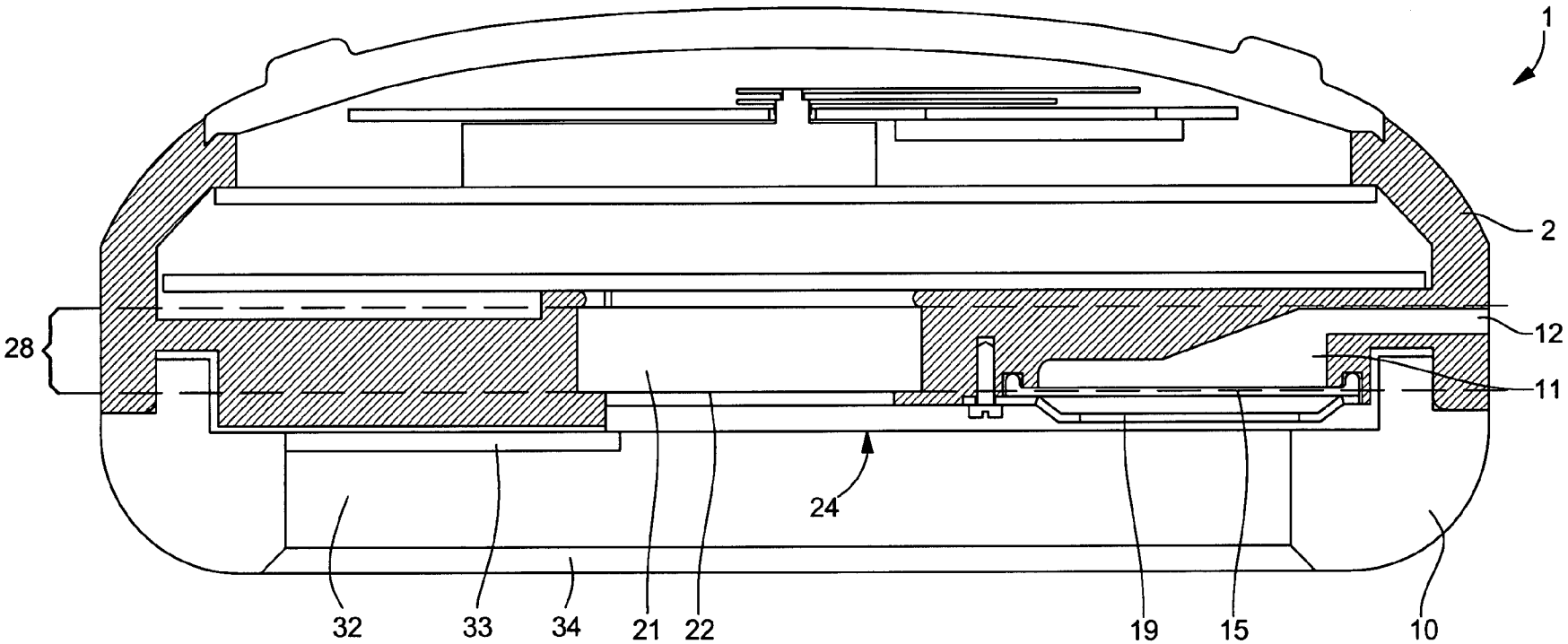
FIG. 2 shows a cross-section of the electroacoustic transducer of a portable apparatus according to a second embodiment.

FIG. 2 shows a similar cross-section to that of FIG. 1, according to a second embodiment of the invention. The reference numerals of those elements common to FIG. 1 have been kept the same.

As is shown, at least one electrical or electronic and preferably voluminous component 32, such as an accumulator, is arranged in back cover 10 of the case. It will be noted that other components can also be present, such as for example a printed circuit board 33 for electrically connecting accumulator 32 to other electrical and electronic components of watch 1 located in case 2.

It will be noted that, advantageously, the position of membrane 15 guarantees the water-resistance of the electrical or electronic elements located in the top part of the case but also those located in back cover 10 of the same case.

In order to be able to replace the components 32 and 33 housed in back cover 10 of the case, according to a first variant, there is provided an access hatch 34 closing back cover 10 in a water-resistant manner, or according to a second advantageous variant, a removable back cover able to be dismantled in order to replace any components that it contains. In this latter case, protective member 19, already presented in FIG. 1, is preferably provided. This latter has a dual function: it is capable on the one hand of supporting deformable membrane 15 when external pressure greater than a predetermined value is applied thereto and, on the other hand, it protects membrane 15 when the back cover 10 of the case is removed. Advantageously, this protective member 19 extends along acoustic channel 24 so as to cover and thus also protect flexible membrane 22 of the dynamic loudspeaker 21.

It will be noted that the different pressure compensation alternatives are also applicable although not visible in this Figure.

Figure 3:
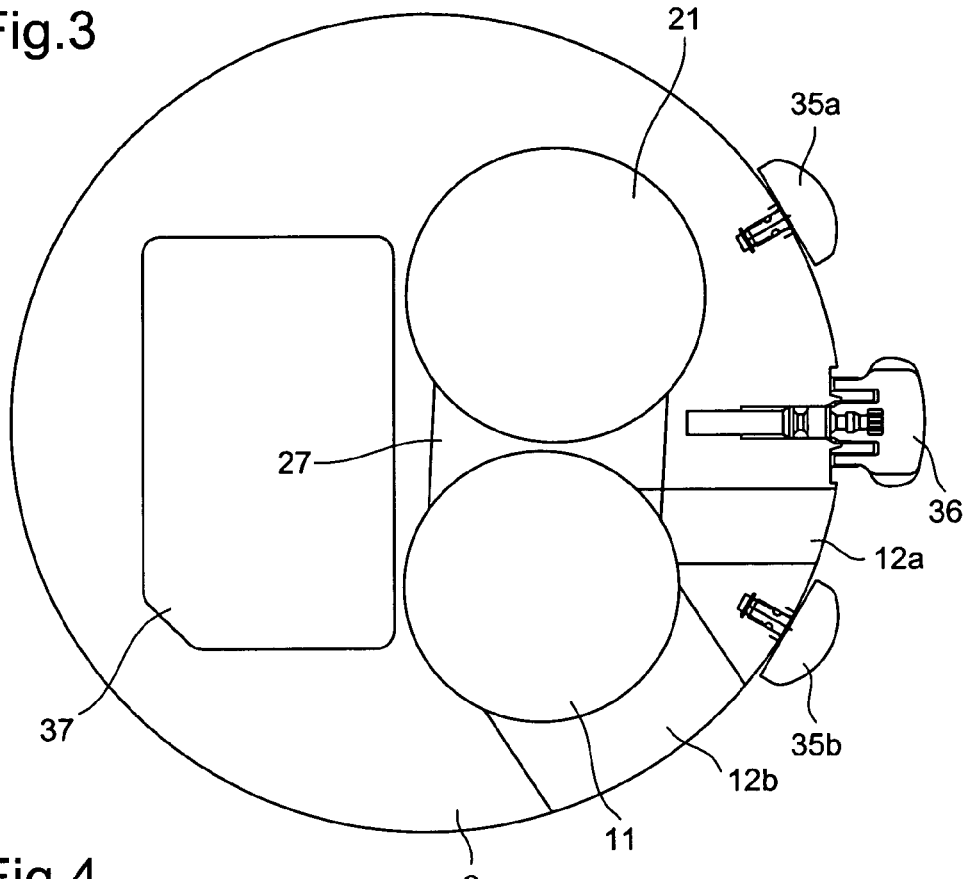
FIG. 3 shows a top view of the electroacoustic transducer.

FIG. 3 is a top view of certain elements of the portable apparatus according to the first two embodiments presented hereinbefore. Those elements common to the preceding Figures are designated by the same reference numerals.

FIG. 3 shows case 2, electrotransducer 21, inlet cavity 11, connecting conduit 27 of the acoustic channel between the transducer and the cavity. As is shown, cavity 11 is in direct communication with the exterior, advantageously through two inlet channels 12*a* and 12*b*, which open out therein laterally. It will be noted that these two channels have different orientations which has the effect of improving the transmission, respectively reception in the case of a microphone, of acoustic vibrations towards the exterior, respectively from the exterior.

The watch includes control members, such as for example two push-buttons 35*a* and 36*b* arranged on either side of a time setting member 36. The operating detail of these control members is conventional and will not be described here. It will be noted that, preferably, channel 12*a* is arranged to open out between a push-button for example button 35*a*, and time setting member 36, the other channel 12*b* being off-centre so as to open out on the other side of button 35*a*.

As is visible, in the case of a telephone watch, a housing 37 is also provided, located substantially in the same slice as transducer 21, for receiving a SIM card.

It will be noted that in an application to a telephone watch, the latter preferably includes a loudspeaker and a microphone, both being as far as possible from each other in the case.

FIG. 4 shows a schematic cross-section of a dynamic electroacoustic transducer. First of all, a "dynamic transducer" means a transducer with a moving conductor, in which the moving part is a conductor through which a current, provided by a source external to the transducer or induced by a magnetic field external to the transducer, passes.

Such a dynamic transducer, a loudspeaker in the case shown, comprises a preferably circular case 101, connected to a magnetic circuit 102 by means of springs 103. An annular groove 104 made in magnetic circuit 102 enables an induction coil 105 to be placed therein. A membrane 106 attached to case 101 and to coil 105 allows acoustic vibrations 107 to be transmitted in the vertical direction symbolised by an arrow. In both embodiments presented in FIGS. 1 and 2, the transducer is advantageously a dual function dynamic transducer, loudspeaker and vibrator. In order to obtain the loudspeaker function by vibrating membrane 106, in particular in audible frequency ranges (300 Hz-3.5 kHz), coil 105 is current controlled by an external control circuit, not shown, the control current that passes through the coil thus induces a magnetic field through the coil, which interacts with the magnetic field created by magnetic circuit 102. In order to obtain the vibrator function, as membrane 106 cannot vibrate sufficiently at a low frequency, the coil is current controlled such that the interaction between the field induced in the coil and the field of magnetic circuit 102 makes transducer case 101 vibrate at a resonant frequency of for example 140 Hz, which then drives the watch assembly. This type of dynamic electrotransducer is available particular from the Japanese Namiki Company®.

The invention claimed is:

1. A water-resistant portable apparatus including a case in which there is mounted an electroacoustic transducer separated from an inlet cavity in a water resistant manner by a deformable membrane, said inlet cavity being arranged in said case and in direct communication with the exterior, wherein said electroacoustic transducer and said inlet cavity are arranged collaterally such that at least one part of a determined thickness of said transducer and respectively said cavity, are arranged in a same slice being parallel to the bottom of said case and wherein an acoustic channel connects said transducer to said deformable membrane to transmit acoustic vibrations.

2. The portable apparatus according to claim 1, wherein said electroacoustic transducer is a dynamic electroacoustic transducer.

3. The portable apparatus according to claim 1, wherein said electro acoustic transducer includes a loudspeaker.

4. The portable apparatus according to claim 3, wherein said loudspeaker includes a flexible membrane arranged facing said acoustic channel.

5. The portable apparatus according to claim 3, wherein said electroacoustic transducer also includes a vibrator.

6. The portable apparatus according to claim 5, wherein said electroacoustic transducer also includes a vibrating element arranged toward the inside of the case.

7. The portable apparatus according to claim 1, wherein said acoustic channel is arranged in the back cover of the case which is separated from the inlet cavity in a water-resistant manner by said deformable membrane.

8. The portable apparatus according to claim 7, wherein the back cover of the case forms a support surface for said deformable membrane when external pressure greater than a predetermined value is applied thereto.

9. The portable apparatus according to claim 7, wherein at least one electrical or electronic component is arranged in the back cover of the case.

10. The portable apparatus according to claim 9, wherein said electrical component is an accumulator.

11. The portable apparatus according to claim 7, wherein the back cover of the case is removable, and wherein a protective member, fixedly mounted in the case, is capable on the one hand of supporting said deformable member when external pressure greater than a predetermined value is applied thereto and on the other hand, of protecting said deformable membrane when the back cover of the case is removed.

12. The portable apparatus according to claim 11, wherein said protective member extends along the acoustic channel so as to also protect the flexible member of said electroacoustic transducer.

13. The portable apparatus according to claim 1, wherein the deformable membrane is a water-resistant and gas-proof membrane and wherein the apparatus further includes pressure-balancing means for balancing the slow differential pressure variations on either side of said deformable membrane.

14. The portable apparatus according to claim 1, wherein said portable apparatus is a telephone watch.

15. A telephone watch according to claim 14, wherein it includes at least one control member on the external periphery of the case and wherein said inlet cavity is in communication with the exterior through at least one inlet channel arranged in proximity to said control member.

16. The telephone watch according to claim 15, wherein it includes two inlet channels oriented along different directions.

* * * * *